US011617929B2

(12) United States Patent
Kobin

(10) Patent No.: US 11,617,929 B2
(45) Date of Patent: Apr. 4, 2023

(54) TRAVEL BAG FOR A GOLF EQUIPMENT

(71) Applicant: Griffen Management OÜ, Harju maakond (EE)

(72) Inventor: Gunnar Kobin, Harju maakond (EE)

(73) Assignee: GRIFFEN MANAGEMENT OÜ, Harju maakond (EE)

( * ) Notice: Subject to any disclaimer, the term of this patent is extended or adjusted under 35 U.S.C. 154(b) by 196 days.

(21) Appl. No.: 16/901,350

(22) Filed: Jun. 15, 2020

(65) Prior Publication Data

US 2021/0252353 A1 Aug. 19, 2021
US 2022/0347533 A9 Nov. 3, 2022

(30) Foreign Application Priority Data

Feb. 19, 2020 (EE) ..... U202000006

(51) Int. Cl.
*A63B 55/30* (2015.01)
*A45C 13/26* (2006.01)
*A45C 5/14* (2006.01)

(52) U.S. Cl.
CPC ..... *A63B 55/30* (2015.10); *A45C 5/14* (2013.01); *A45C 13/262* (2013.01); *A63B 2209/00* (2013.01)

(58) Field of Classification Search
CPC ... A45C 2003/007; A45C 13/262; A45C 5/14; A63B 55/30; A63B 2209/00
See application file for complete search history.

(56) References Cited

U.S. PATENT DOCUMENTS 2,472,491 A * 6/1949 Quinton ..... A45C 5/146 280/37
3,566,994 A 3/1971 Isaacs
3,799,568 A * 3/1974 Hager ..... A45C 13/26 280/37
3,948,365 A * 4/1976 Gregg ..... A45C 5/14 190/18 A (Continued)

FOREIGN PATENT DOCUMENTS

CN 207202348 U 4/2018
DE 4003561 C1 2/1991

(Continued)

OTHER PUBLICATIONS

Estonian Search Report and an English Translation of the Search Report.

(Continued)

*Primary Examiner* — Jennifer Robertson
*Assistant Examiner* — Justin Caudill
(74) *Attorney, Agent, or Firm* — Ladas & Parry LLP

(57) ABSTRACT

A travel bag for golf equipment. The bag has a rear part provided with a first pair of castors and in the bottom of the rear part a stiffening plate that does not extend to the front part of the bag. Under the travel bag at the other end of the stiffening plate is a second pair of castors so that in the horizontal position of the bag the rear part of the bag is supported by the first and second pairs of castors and the front part of the bag is supported on the ground. The front part of the bag can be pulled off the ground using grab element so that the bag can trail on the first and second pairs of castors behind the user.

12 Claims, 1 Drawing Sheet

(56) References Cited

U.S. PATENT DOCUMENTS 4,299,313 A * 11/1981 Null ..... A45C 13/262 16/113.1
4,561,526 A * 12/1985 Winter ..... A45C 13/262 16/113.1
4,657,135 A 4/1987 Kjose
4,928,800 A * 5/1990 Green ..... A45C 13/262 190/115
4,951,818 A * 8/1990 Johnson ..... A45C 5/14 190/107
5,108,119 A * 4/1992 Huang ..... B62B 1/125 280/37
5,109,961 A 5/1992 Bergman
5,253,739 A * 10/1993 King ..... A45C 5/14 190/115
5,351,792 A * 10/1994 Cohen ..... A45C 5/14 190/18 A
5,435,423 A * 7/1995 Rekuc ..... A45C 5/14 190/114
5,645,146 A * 7/1997 Bieber ..... A45C 13/262 280/37
5,749,503 A * 5/1998 Wulf ..... A45C 7/0086 224/652
6,148,971 A * 11/2000 Kho ..... A45C 5/14 190/115
6,230,656 B1 * 5/2001 Walach ..... A01K 1/0236 119/453
6,330,944 B1 * 12/2001 DeMichele ..... A63B 55/406 206/315.3
6,508,359 B1 * 1/2003 He ..... A63B 55/60 206/315.6
6,745,877 B1 * 6/2004 Tsai ..... A45C 13/22 190/115
6,892,773 B1 * 5/2005 Wenzler ..... A63B 55/60 150/159
7,011,195 B1 * 3/2006 Kho ..... A45C 5/14 190/115
7,874,408 B2 * 1/2011 Suppancig ..... A45C 13/262 190/115
9,084,920 B2 * 7/2015 Andochick ..... A45C 5/14
2003/0029750 A1 2/2003 Boardman et al.
2003/0062233 A1 * 4/2003 Sharples ..... A45C 5/06 190/111
2003/0085540 A1 * 5/2003 Sadow ..... A45C 7/0045 280/655.1
2003/0111370 A1 6/2003 Sanderson et al.
2004/0216970 A1 11/2004 Sherrell et al.
2006/0006034 A1 * 1/2006 Nordstrom ..... A63B 55/60 150/159
2008/0110711 A1 * 5/2008 Coughlin ..... A45C 13/02 190/9
2009/0255772 A1 10/2009 Sherrell et al.
2011/0083933 A1 * 4/2011 Engel ..... A45C 7/0077 190/107
2012/0055750 A1 * 3/2012 Xiao ..... A45C 7/0063 190/18 A
2013/0334081 A1 12/2013 Loudenslager et al.
2015/0266664 A1 * 9/2015 Noer ..... A45C 13/02 206/216
2015/0283435 A1 10/2015 Andochick

FOREIGN PATENT DOCUMENTS

FR 2 786 074 A1 5/2000
GB 2245543 A 1/1992
WO 84/03638 A1 9/1984

OTHER PUBLICATIONS

CN 207202348 U_English_Translation.
FR 2 7860 74 A1_English_Translation.

* cited by examiner

TRAVEL BAG FOR A GOLF EQUIPMENT

TECHNICAL FIELD

The present invention relates to a travel bag or a transport bag for a golf equipment.

In order to enable convenient transport of golf equipment, there are special travel bags for golf equipment. A typical travel bag for a golf equipment is rectangular or tubular bag made of wear-proof fabric or other similar material with a width of approximately 35 cm, height 35 cm, and length 1.3 m. Generally, the travel bag comprises castors at one end under the bottom at the edge, and at the other end at the side of the user, a grab element intended for grabbing and holding in the form of, for example, a carrying strap or carrying handle, which the user can grab to lift one end off the ground and to trail the travel bag with an angle of approximately 25 to 35 degrees on the castors located at the other end. Depending on the manufacturer, a stiffening plate is provided under the bottom of the travel bag in the extent of ⅓ to ⅔ of the length of the bottom (this can be also called a bottom plate or reinforcement plate) for retaining the form of the travel bag and protecting the equipment inside the bag.

Weight of the golf equipment, including golf bag (i.e. without the travel bag), is approximately 15 kg. If this equipment, including the golf bag, is placed in a travel bag and additional items are added, such as golf clothes, footwear, golf balls, etc., a travel bag for a golf equipment ready for travel may weigh 20 to 30 kg. Trailing a travel bag with such weight requires physical effort and it is therefore rather inconvenient. It would be more comfortable to trail the travel bag without the need for lifting it off the ground to an angle of 25 to 35 degrees.

With the present invention, a solution is provided for making the transport of golf equipment during travel more convenient and less strenuous for the user.

BACKGROUND ART

As a solution closest to the present invention known from the prior art, U.S. Pat. No. 6,330,944B1 (published 18 Dec. 2001) describes a travel bag for a golf equipment comprising a pair of castors under the bottom of the travel bag at the rear end of the travel bag and a grab element at the other end of the travel bag, while the bottom of the travel bag comprises a stiffening plate (in a specific solution, a rear cover with the relevant function) in the extent of at least 50% of the length of the bottom of the travel bag measured from the castors located at the end of the travel bag). The second pair of castors is located under the bottom of the travel bag near the other end of the stiffening plate, so that the part of the travel bag including the stiffening plate rests on the castors located at the end of the travel bag and on the second pair of castors. In a horizontal position, the travel bag rests only on castors and can roll on castors when pulled from the strap fixed to the travel bag in the pulling direction. In this known solution, the front pair of castors is retractable by an additional mechanism, which makes the solution more expensive and complicated, and also susceptible to failures, as during use, foreign objects may enter between the mechanism (e.g. debris, sand, gravel, etc.).

DISCLOSURE OF THE INVENTION

In order to eliminate the listed shortages, the present invention provides a travel bag for a golf equipment, comprising a pair of castors at the rear end under the bottom of the travel bag and a grab element at the other end of the travel bag, which may be provided, for example, in the form of a carrying strap or plastic carrying handle. The bottom of the travel bag comprises a stiffening plate in the extent of at least 50% of the length of the bottom of the travel bag measured from the castors located at the rear end of the travel bag.

The second pair of castors is located under the bottom of the travel bag near the other end of the stiffening plate, so that the rear part of the travel bag including the stiffening plate rests on the castors located at the end of the travel bag and on the second pair of castors when the travel bag is in the horizontal position, whereby the front part of the travel bag without the stiffening plate rests on the ground.

By pulling the grab element at the end of the travel bag or a strap fixed to it (or cord, string, etc.), the front part of the travel bag can be lifted off the ground, so that the travel bag rests on the ground only with its castors and it can roll on castors in the pulling direction.

The mentioned grab element itself may have sufficient length, for example, when implemented as a carrying strap, for grabbing its end and lifting up the front part of the travel bag, or when a shorter carrying strap or carrying handle is used as the grab element, an additional strap, cord or string is fixed to the grab element to enable convenient lifting of the front part of the travel bag and the trailing of the travel bag.

In the second embodiment of the travel bag for a golf equipment, the castors of the second pair of castors are self-aligning castors according to the direction of travel, or in other words, they are self-turning castors according to the rolling direction.

In a preferred embodiment of the travel bag, the front part of the travel bag lacking the stiffening plate comprises at least one resting slat for supporting said front part to the ground.

BRIEF DESCRIPTION OF THE DRAWINGS

Figures include schematic depictions of the travel bag, i.e. zippers or other closing elements and pockets on the outer surface of the travel bag or any stiffening elements for retaining the shape of the travel bag are not shown.

MODE(S) FOR CARRYING OUT THE INVENTION

Figure 1:
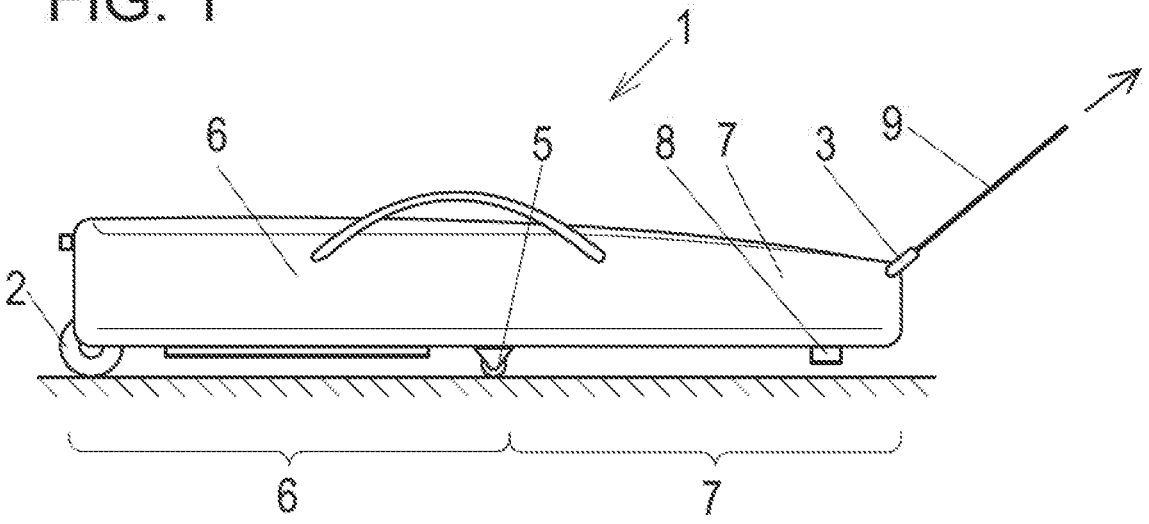
FIG. 1—side view of the travel bag 1 on the move, where the front part 7 of the travel bag has been lifted off the ground by pulling the strap 9 and the travel bag 1 can roll on the castors 2 and 5 behind the user.

The travel bag is manufactured of a flexible material, such as waterproof fabric or any other suitable flexible material, such as plastic-coated fabric, etc.

In addition to the castors 2 at one end of the travel bag 1, an additional pair of castors 5 is provided under the bottom of the travel bag 1 in the extent of approximately 50%-65% of the total length of the travel bag 1 (measured from the rear castors 2) preferably with the same longitudinal direction as the rear castors 2 of the travel bag 1. In other words, in the horizontal position of the travel bag 1 shown on the figures, the rear part 6 of the travel bag 1 comprising the stiffening plate 4 rests on the castors 2 and 5.

Figure 2:
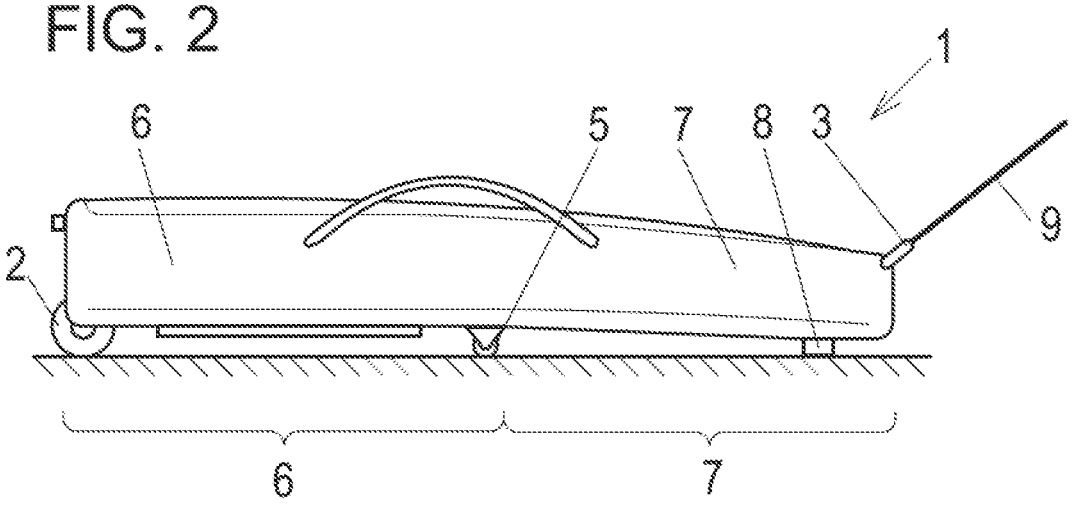
FIG. 2—side view of the travel bag 1 in a stationary state, i.e. the front part 7 of the travel bag rests on the ground with the resting slat 8 and the travel bag cannot freely roll.
Figure 3:
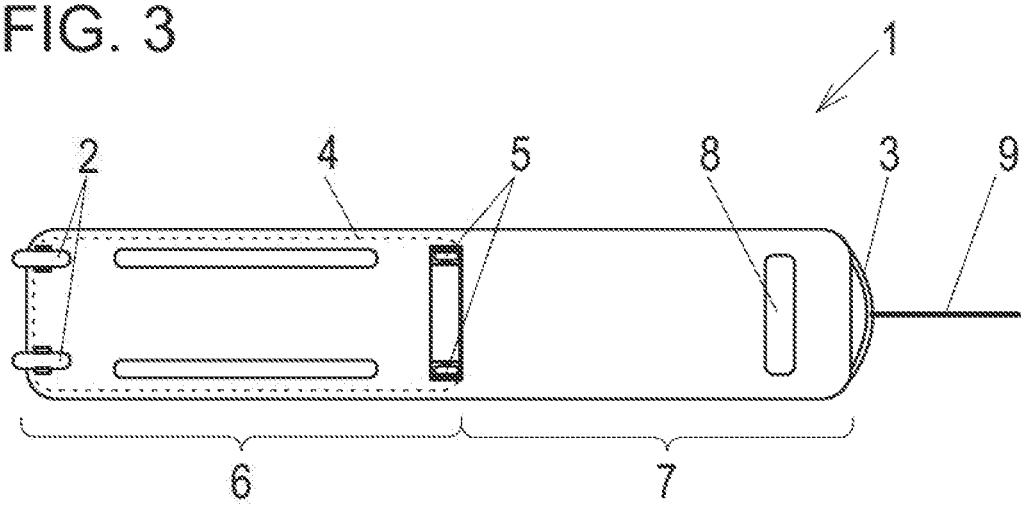
FIG. 3—a bottom view of the travel bag with a dotted line indicating the outline of the stiffening plate.

In the embodiment shown on FIGS. 1 to 3, the castors of the additional pair of castors 5 are fixed to roll along a straight-line path, i.e. these castors cannot swivel.

In another embodiment, the castors of the second pair of castors 5 are self-aligning or self-turning according to the direction of rolling (travel) to simplify maneuvering with the travel bag (not shown).

The pair of castors 5 is anchored to the stiffening plate 4 providing stiffness to the travel bag 1 (indicated with dotted line on FIG. 3), which means that for implementing the solution of the invention, the stiffening plate 4 of the bottom of the travel bag 1 must extend at least 50% of the length of the travel bag 1. The stiffening plate 4 may be integrated into the bottom of the travel bag 1, as shown on the figures, or optionally, it may be separately fixed onto the bottom of the travel bag from outside. As shown in FIG. 3, the stiffening plate 4 may be a quadrilateral having opposed front and rear edges with the pair of castors 5 disposed at the front edge and the pair of casters 2 disposed at the rear edge.

In result, the rear part 6 of the travel bag 1 equipped with the stiffening plate 4 resting on the castors 2 and 5 is provided under the travel bag 1 in the extent of approximately 50-65% of the length measured from the rear castors 2, see FIG. 3.

The front part 7 of the travel bag comprising the grab element 3, i.e. 35-50% of the length of the bottom of the travel bag 1, is not equipped with the stiffening plate 4.

This is important to ensure that the front part 7 of the travel bag functions as a brake hindering free rolling of the part with castors 2 and 5, for which purpose the resting slat 8 under the bottom of the travel bag 1 is provided, i.e. when the travel bag 1 is placed on the ground, the front part 7 of the travel bag settles down against the ground, i.e. the resting slat 8 rests on the ground and prevents the rolling of the travel bag 1, see FIG. 2.

When using the travel bag, the user connects to the grab element 3 located at the front part 7 of the travel bag 1 (e.g. if the element itself is not long enough or is provided as a carrying handle) the strap 9 (or cord or string), upon pulling of which the front part 7 of the travel bag 1 is lifted off the ground together with the resting slat 8, after which the travel bag can roll on the castors 2 and 5 behind the user of the travel bag when pulled from the strap 9, see FIG. 1. Strap 9 may be fixed directly to the grab element 3, or when the grab element 3 is provided, for example, as a carrying handle, the ends of the strap may be fixed to the fixing eyelets of the carrying handle (not shown).

In the second embodiment, the mentioned grab element 3 itself is long enough, for example, it is provided as a carrying strap, enabling the user to grab its end and lift up the front part 7 of the travel bag 1—in this case, the strap 9 shown on the figures is not required.

When pulling the travel bag 1 from the mentioned strap 9, the front part 7 of the travel bag is lifted off the ground, because it does not comprise the stiffening plate 4, which enables the travel bag 1 to roll freely on the castors 2 and 5 in the pulling direction of the strap 9.

When pulling the strap 9 is stopped and the front part 7 of the travel bag 1 equipped with the strap 9 is rested on the ground with the resting slat 8, it prevents the rolling of the travel bag 1 on the castors 2 and 5, and the travel bag is fixed on the spot.

Precise lengths of the travel bag 1 and locations of the pairs of castors 2 and 5 depend on the model of the specific travel bag 1 and other structural peculiarities and may thus vary, but more important is that the bottom of the travel bag 1 (rear part 6) must be stiffened from the rear castors 2 to the front castors 5 with, for example, a stiffening plate, the additional pair of castors 5 must be located approximately 50%-65% away from the rear castors 2 of the travel bag 1, and the front part 7 of the travel bag 1 may not be stiffened, but must be able to settle down against the ground when the strap 9 is released, thus preventing any movement of the travel bag.

An advantage of the solution provided with the present invention is that the castors 2 and 5 do not need a separate locking/braking system, because when pulling the travel bag 1 is stopped, the front part 7 of the travel bag lacking the stiffening plate 4 will settle down against the ground due to its weight and is resting on the resting slat 8, whereas this resting slat 8 is acting as a parking brake.

Furthermore, the main weight of the travel bag 1 and the equipment inside the bag is resting on the castors 2 and 5, and for trailing the travel bag 1 the strap 9 should be pulled only to such extent that the front part 7 of the travel bag 1 is lifted off the ground together with the resting slat 8, after which the travel bag 1 will roll behind the user when pulled.

It is also possible to stack other travel bags/trunks and other equipment on the rear part 6 of the bag 1 comprising the stiffening plate 4 and to transport these on the travel bag by trailing the travel bag. This additional weight has no impact on the front part 7 of the travel bag—it can be lifted off the ground with similar pulling force and thus enables trailing the entire travel bag together with additional weight placed on the rear part 6.

The invention claimed is:

1. A travel bag for golf equipment, comprising a first pair of castors at a rear end under a bottom of the travel bag and a grab element at a front end of the travel bag, wherein the bottom of the travel bag comprises a stiffening plate having opposed front and rear edges, the stiffening plate extending from the rear edge to the front edge at least 50% of a length of the bottom of the travel bag measured from the first pair of castors located at the rear end of the travel bag, and a second pair of castors located under the bottom of the travel bag near the front edge of the stiffening plate, wherein the stiffening plate is disposed in a rear part of the travel bag and does not extend to a front part of the travel bag, the front part of the travel bag without the stiffening plate being configured and dimensioned such that, with the first and second pairs of casters on the ground, the front part of the travel bag can settle down against the ground lower than the rear part of the travel bag and act as a brake to hinder rolling of the casters and, by pulling the grab element at the end of the travel bag, the front part of the travel bag can be lifted off the ground so that the travel bag rests on the ground only on the first and second pairs of castors and can roll on the first and second pairs of castors in the pulling direction.

2. The travel bag for a golf equipment according to claim 1, wherein the front part of the travel bag lacking the stiffening plate comprises at least one resting slat for supporting said front part to the ground.

3. The travel bag for a golf equipment according to claim 2, wherein the grab element is provided as a carrying strap or a carrying handle.

4. The travel bag for a golf equipment according to claim 2, wherein the castors of the second pair of castors are self-aligning according to the direction of travel.

5. The travel bag according to claim 2, wherein the travel bag is made of a flexible material.

6. The travel bag according to claim 5, wherein the stiffening plate does not extend more than about 65% of the length of the bottom of the travel bag measured from the first pair of castors located at the rear end of the travel bag.

7. The travel bag for a golf equipment according to claim 1, wherein the grab element is provided as a carrying strap or a carrying handle.

8. The travel bag for a golf equipment according to claim 7, wherein the castors of the second pair of castors are self-aligning according to the direction of travel.

9. The travel bag for a golf equipment according to claim 1, wherein the castors of the second pair of castors are self-aligning according to the direction of travel.

10. The travel bag according to claim 1, wherein the stiffening plate does not extend more than about 65% of the length of the bottom of the travel bag measured from the first pair of castors located at the rear end of the travel bag.

11. The travel bag according to claim 1, wherein the travel bag is made of a flexible material.

12. The travel bag according to claim 11, wherein the stiffening plate does not extend more than about 65% of the length of the bottom of the travel bag measured from the first pair of castors located at the rear end of the travel bag.

* * * * *